US009831624B2

(12) United States Patent
Garvey et al.

(10) Patent No.: US 9,831,624 B2
(45) Date of Patent: Nov. 28, 2017

(54) PLUG ASSEMBLIES

(71) Applicant: Overlooked Solutions, Inc., Nashville, IN (US)

(72) Inventors: Norbert P. Garvey, Nashville, IN (US); David M. Hurrle, Encinitas, CA (US)

(73) Assignee: Overlooked Solutions, Inc., Nashville, IN (US)

( * ) Notice: Subject to any disclaimer, the term of this patent is extended or adjusted under 35 U.S.C. 154(b) by 0 days.

(21) Appl. No.: 14/735,986

(22) Filed: Jun. 10, 2015

(65) Prior Publication Data

US 2015/0364885 A1 Dec. 17, 2015

Related U.S. Application Data

(60) Provisional application No. 62/010,843, filed on Jun. 11, 2014.

(51) Int. Cl.

| | |
|---|---|
| ***H01R 31/06*** | (2006.01) |
| ***H01R 13/516*** | (2006.01) |
| ***H01R 24/30*** | (2011.01) |
| *H01R 13/50* | (2006.01) |
| *H01R 13/512* | (2006.01) |
| *H01R 13/58* | (2006.01) |

(52) U.S. Cl.

CPC ..... *H01R 31/06* (2013.01); *H01R 13/516* (2013.01); *H01R 24/30* (2013.01); *H01R 13/501* (2013.01); *H01R 13/512* (2013.01); *H01R 13/5825* (2013.01)

(58) Field of Classification Search

CPC ..... H01R 13/639; H01R 31/06; H01R 25/006

See application file for complete search history.

(56) References Cited

U.S. PATENT DOCUMENTS

| | | | | | |
|---|---|---|---|---|---|
| 4,927,377 | A | | 5/1990 | Bach | |
| 5,007,857 | A | | 4/1991 | Wright | |
| 5,217,387 | A | | 6/1993 | Hull | |
| 5,348,494 | A | * | 9/1994 | Falossi | H01R 13/516 439/362 |
| 5,393,243 | A | * | 2/1995 | Carmo | H01R 13/6392 439/369 |
| 6,080,004 | A | * | 6/2000 | Kovacik | H01R 13/6392 439/352 |

(Continued)

*Primary Examiner* — Truc Nguyen

(74) *Attorney, Agent, or Firm* — Maschoff Brennan

(57) ABSTRACT

Plug assemblies and related kits and techniques for using the same are disclosed herein. In one non-limiting aspect, a plug assembly protects an existing plug of a cord and facilitates replacement of a second plug that is engageable with the existing plug in the event the second plug is damaged. In one embodiment, an assembly includes a first plug member with male and female end portions, and a retaining element configured to engage with the first plug member and at least a portion of a cord that includes a second plug member configured to engage with the first plug member. When the retaining element is engaged with the first plug member, one of the female end portion and the male end portion of the first plug member is accessible for engagement with a third plug member. Additional and/or alternative embodiments, forms, features and aspects are disclosed herein.

18 Claims, 9 Drawing Sheets

(56) References Cited

U.S. PATENT DOCUMENTS 6,227,892 B1 * 5/2001 Kera ..... H01R 13/622 439/320
6,350,139 B1 * 2/2002 Haag ..... H01R 13/6395 439/320
6,454,576 B1 * 9/2002 Hedrick ..... H01R 13/5812 439/105
6,957,977 B1 * 10/2005 Miller ..... H01R 13/6392 439/369
6,971,883 B1 * 12/2005 Ridge ..... H01R 13/516 439/142
7,867,015 B1 1/2011 Parker
7,946,244 B2 * 5/2011 Dowler ..... G09F 3/205 116/307
8,647,131 B1 2/2014 Wiebusch
2004/0110426 A1 * 6/2004 Castaldo ..... H01R 24/28 439/696
2008/0057767 A1 * 3/2008 O'Rourke ..... H01R 31/02 439/345
2011/0256750 A1 * 10/2011 Chen ..... H01R 13/506 439/345
2013/0052853 A1 * 2/2013 Natter ..... H01R 13/506 439/345
2013/0164969 A1 * 6/2013 Wu ..... H01R 13/582 439/460
2013/0237088 A1 * 9/2013 Sathyanarayana ... H01R 25/006 439/521
2014/0099808 A1 * 4/2014 McClelland ..... H01R 13/6205 439/153
2015/0303615 A1 * 10/2015 Daugherty, Jr. ..... H01R 13/512 385/55

* cited by examiner

PLUG ASSEMBLIES

CROSS-REFERENCE TO RELATED APPLICATIONS

This application claims the benefit of, and priority to, U.S. Provisional Patent Application No. 62/010,843 filed 11 Jun. 2014, titled "Plug Assemblies" and the contents of which are incorporated herein by reference in their entirety.

BACKGROUND

The present disclosure generally relates to plug assemblies, and more particularly but not exclusively, to assemblies for protecting an existing plug of a cord and facilitating ready replacement of a second plug that is engageable with the existing plug in the event the second plug is damaged.

Cords having one or more plugs are subject to damage during use due to a variety of factors. For example, use of an electrical cord in certain situations may impart stresses on the cord at or near a plug end which over time may result in electrical shorting in the cord such that provision of electricity through the cord may become intermittent depending on the positioning of the cord. The plug end or ends of an electrical cord may also be damaged during use. For example, one or more prongs of the cord could break due to fatigue or impact by another object.

Once a cord is damaged, for safety reasons and to facilitate continued use of the cord, it is often necessary to replace at least one plug end of the cord. In the electrical power cord realm, some regulations stipulate that the original plug end may only be replaced by the original manufacturer in order for the cord to continue to satisfy safety requirements. Repairs performed by the original manufacturer are costly and often result an extended period of time where the cord, and in certain cases any device or tool attached thereto, is not available for use. The damaged, original plug end may also be replaced by a user of the cord, but doing so can be time consuming and existing plug end replacements suffer from shortcomings relative to the original plug end.

In view of the foregoing, there remains a need for further contributions in this area of technology.

The claimed subject matter is not limited to embodiments that solve any disadvantages or that operate only in environments such as those described above. Rather, this background is only provided to illustrate examples of where the present disclosure may be utilized.

BRIEF SUMMARY

The present disclosure generally relates to plug assemblies, and more particularly but not exclusively, to assemblies for protecting an existing plug of a cord and facilitating replacement of a second plug that is engageable with the existing plug in the event the second plug is damaged.

In one embodiment, an assembly includes a first plug member with male and female end portions, and a retaining element configured to engage with the first plug member and at least a portion of a cord that includes a second plug member configured to engage with the first plug member. When the retaining element is engaged with the first plug member, one of the female end portion and the male end portion of the first plug member is accessible for engagement with a third plug member.

In alternative embodiments, assemblies, systems, apparatuses, and devices relating to a plug end of a cord are provided.

This Summary is provided to introduce a selection of concepts in a simplified form that are further described below in the Detailed Description. This Summary is not intended to identify key features or essential characteristics of the disclosed subject matter, nor is it intended to be used as an aid in determining the scope of the disclosed subject matter.

Additional features and advantages will be set forth in the description which follows, and in part will be obvious from the description, or may be learned by the practice of the invention. The features and advantages may be realized and obtained by means of the instruments and combinations particularly pointed out in the appended claims. These and other features of the present invention will become more fully apparent from the following description and appended claims, or may be learned by the practice of the invention as set forth hereinafter.

DETAILED DESCRIPTION

For purposes of promoting an understanding of the present disclosure, reference will now be made to the following embodiments and specific language will be used to describe the same. It will nevertheless be understood that no limitation of the scope of the disclosure is thereby intended, such alterations and further modifications in the described subject matter, and such further applications of the disclosed principles as described herein being contemplated as would normally occur to one skilled in the art to which the disclosure relates.

The terms and words used in the following description and claims are not limited to the bibliographical meanings, but, are merely used to enable a clear and consistent understanding of the disclosure. It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Figure 1:
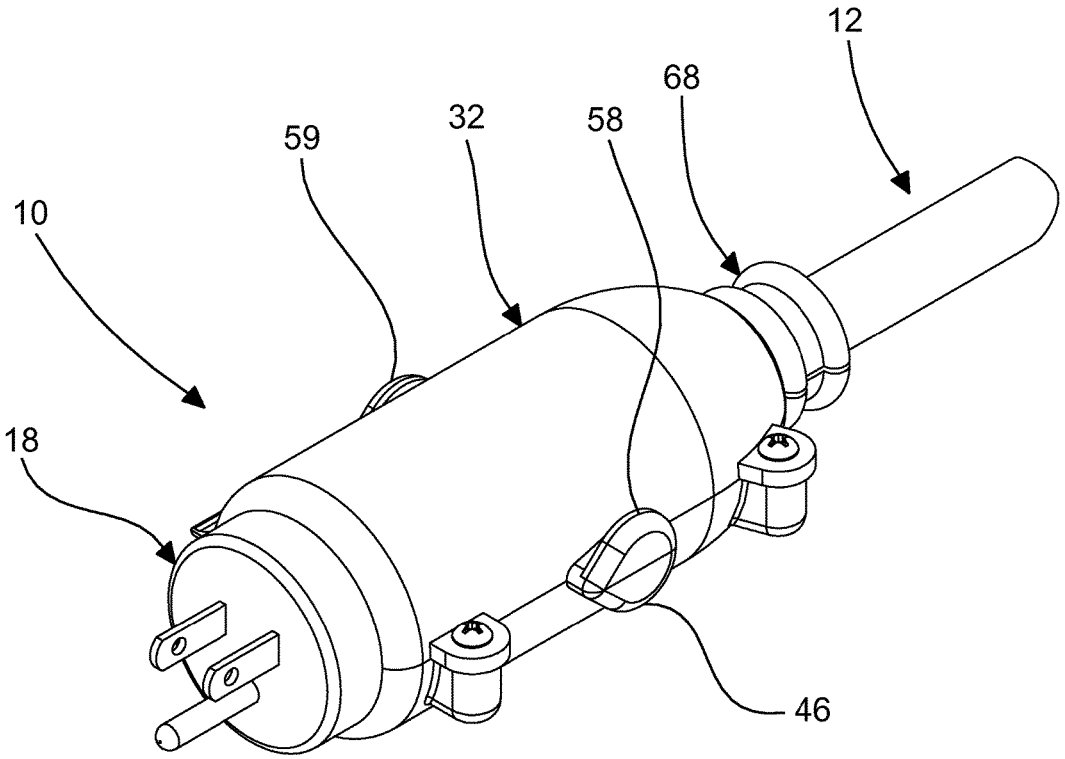
FIG. 1 is a perspective view of a plug assembly engaged with the male end of a cord.

The present disclosure generally relates to plug assemblies, and more particularly but not exclusively, to assemblies for protecting an existing plug of a cord and facilitating replacement of a second plug that is engageable with the existing plug in the event the second plug is damaged. Further details of one non-limiting plug assembly 10 are illustrated in FIGS. 1-5. Plug assembly 10 generally includes a plug member 18, a retaining member 32 and a strain relief member 68. In FIG. 1, plug assembly 10 is illustrated in perspective view and engaged with a cord 12 structured to provide electrical power. More particularly, as illustrated in the exploded view of FIG. 2, plug assembly 10 is engaged with a male plug end 14 from which a cord portion 16 of cord 12 extends. It should be understood that plug assembly 10 may also be engaged with a female end of cord 12 as illustrated in FIG. 5 for example. Cord 12 may be, for example, an extension cord or a cord extending from an electrically powered device or tool, amongst other possibilities.

Figure 3A:
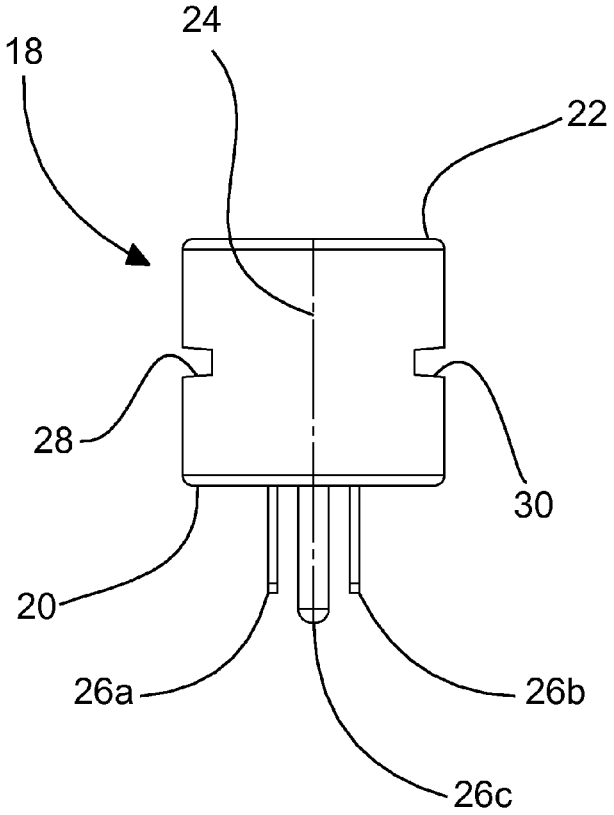
FIG. 3A is a top plan view of a plug member of the plug assembly of FIG. 1.
Figure 3B:
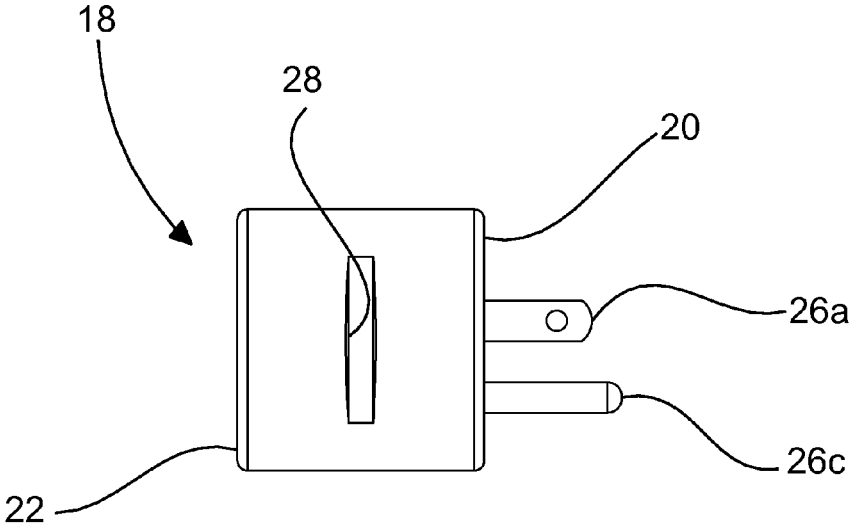
FIG. 3B is a side plan view of the plug member of FIG. 3A.

As illustrated in FIGS. 3A and 3B for example, plug member 18 extends between a male end 20 and a female end 22 along axis 24. Male end 20 includes a plurality of prongs 26*a*-26*c* which in the illustrated form are configured for use in connection with a 115V power source. For example, prongs 26*a*-26*c* are configured to provide connection between power, neutral and ground lines of different cords or power sources. It should be appreciated however that plug member 18 may include prongs configured for use in connection with a different type of power source. Female end 22 of plug member 18 includes a plurality of receptacles 27*a*-27*c* (FIG. 1) configured to receive prongs configured the same or substantially similar to prongs 26*a*-26*c*.

Plug member 18 also includes a pair of receptacles 28, 30 positioned between male and female ends 20, 22 and extending transversely to axis 24. While receptacles 28, 30 are formed as elongated slots or grooves in the illustrated form, it should be understood that different configurations for receptacles 28, 30 are possible. In the illustrated form, plug member 18 includes a cylindrical configuration and receptacles 28, 30 are diametrically opposed from one another. However, it should be understood that receptacles 28, 30 may be positioned differently relative to one another, and that in forms where plug member 18 does not include a cylindrical body they may be positioned opposite of one another but not necessarily diametrically from one another. Plug member 18 may also include one or more receptacles in addition to receptacles 28, 30, and forms in which plug member 18 only includes a single receptacle of this nature are also contemplated.

It should be understood that plug member 18 is configured to engage with a male or female end of a cord or a power source, and also with another plug of a different cord. For example, if male end 20 of plug member 18 is engaged with a power source or the female end of a cord, then the male end of another cord may be engaged with female end 22 of plug member 18. Alternatively, if the male end of a cord is engaged with female end 22 of plug member 18, then male end 20 of plug member 18 may be engaged with another female plug or a power source for example.

Retaining member 32 is configured to engage with plug member 18 and one or more portions of cord 12 in order to retain engagement of plug member 18 with cord 12. In the illustrated form, retaining member 32 surrounds plug 14 of cord 12 and may therefore also provide protection thereto. Forms in which retaining member 32 is structured to only partially surround or enclose plug 14 of cord 12 are also possible. In the illustrated form, retaining member 32 extends between a first end 34 and an opposite second end 36. Retaining member 32 further includes a first portion 38 which is hingedly coupled with a second portion 48 via a flexible portion 50. In this configuration, flexible portion 50 provides a living hinge between first and second portions 38, 48; however it should be understood that alternative arrangements for permitting movement between first and second portions 38, 48 are possible.

First portion 38 of retaining member 32 includes a hollow interior 40 which communicates with a first opening 42 and a second opening 44. In the illustrated form, first and second openings 42, 44 have an arcuate configuration and the radius of first opening 42 is larger than the radius of second opening 44. It should be appreciated that alternative configurations, shapes and/or sizes for first and second openings 42, 44 are also possible. First portion 38 also includes a first projection or tab 46 positioned on its exterior surface between first and second ends 34, 36 and a second tab or projection (not shown) positioned opposite of first projection 46; a pair of projections 45, 47 positioned opposite of one another and extending partially into hollow interior 40 near end 34; and a pair tabs 41*a*, 41*b* with receptacles 43*a*, 43*b*, respectively.

Second portion 48 of retaining member 32 includes a hollow interior 52 which communicates with a first opening 54 and a second opening 56. In the illustrated form, first and second openings 54, 56 have an arcuate configuration and the radius of first opening 54 is larger than the radius of second opening 56. It should be appreciated that alternative configurations, shapes and/or sizes for first and second openings 54, 56 are also possible. Second portion 48 also includes a first projection or tab 58 positioned on its exterior surface between first and second ends 34, 36 and a second tab or projection 59 (FIG. 1) positioned opposite of first projection 58; a pair of projections 51, 53 positioned opposite of one another and extending partially into hollow interior 52 near end 34; and a pair of tabs 60, 62 each including a fastener 64, 66, respectively, configured to engage with receptacles 43*a*, 43*b*.

Figure 2:
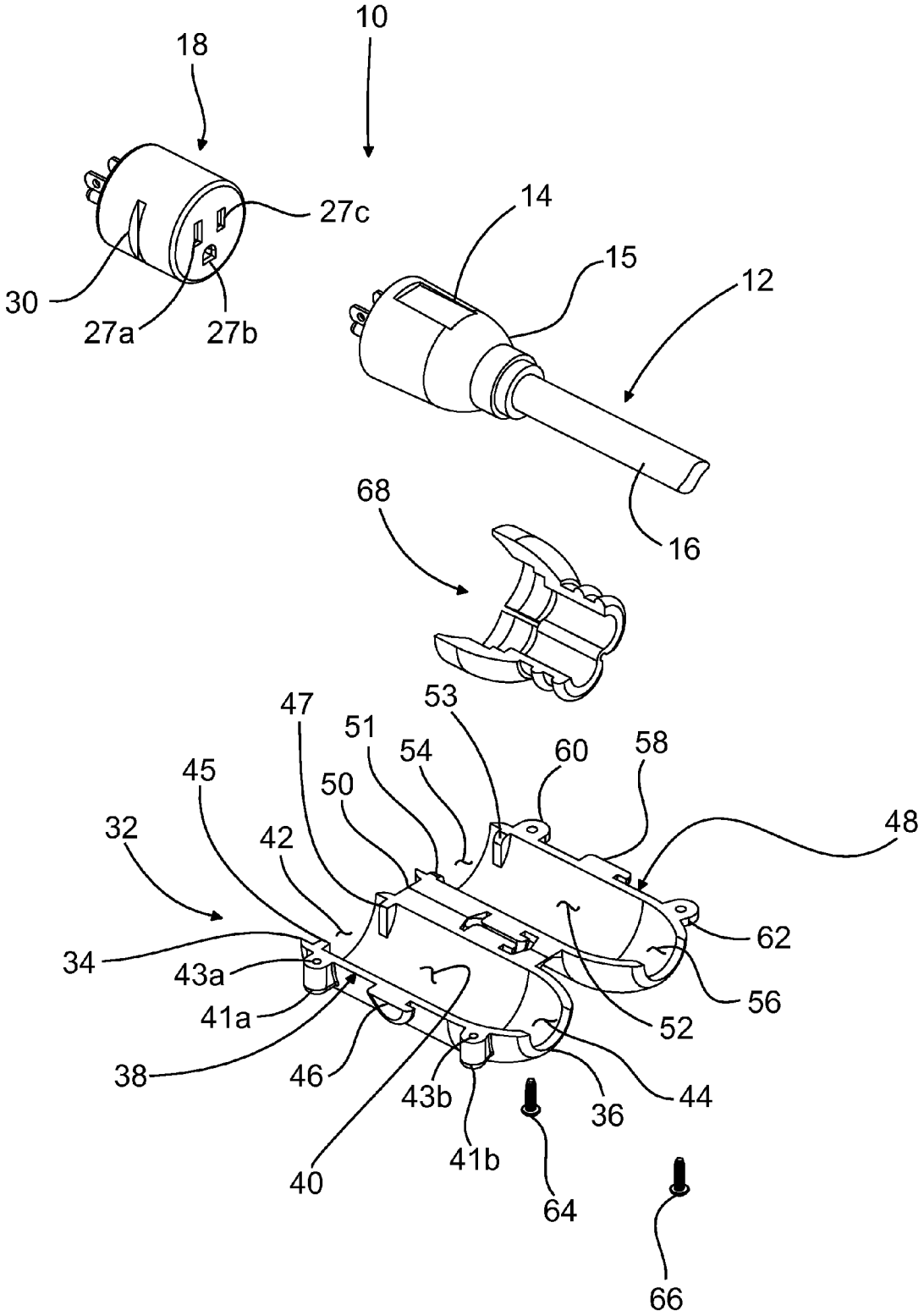
FIG. 2 is an exploded view of the plug assembly of FIG. 1.

As indicated above, first and second portions 38, 48 of retaining member 32 are hingedly coupled to one another. In this configuration, first and second portions 38, 48 of retaining member 32 are positionable relative to one another between a first, open configuration as illustrated in FIG. 2 and a second, closed configuration as illustrated in FIG. 1. In the open configuration illustrated in FIG. 2 for example, retaining member 32 may be positioned for engagement with plug member 18 and cord 12 when they are engaged with one another. Once retaining member 32 is properly positioned, first and second portions 38, 48 may be moved relative to one another to the closed configuration in order to engage retaining member 32 with plug member 18 and cord 12. Fasteners 64, 66 may then be engaged with receptacles 43*a*, 43*b* in order to retain retaining member 32 in the closed configuration and in engagement with plug member 18 and cord 12. In the illustrated form, fastening members 64, 66 are threaded screws although other forms for fastening members 64, 66 are contemplated. Retaining member 32 may include one or more features in addition to or in lieu of fasteners 64, 66 for keeping retaining member 32 in the closed configuration. For example, in one non-illustrated form, one of first and second portions 38, 48 may include a latching mechanism, projection, tab, etc. which engages with suitable structure on the other of first and second portions 38, 48 in order to maintain the closed configuration of retaining member 32.

While not previously discussed, it should be appreciated that hollow interiors 40, 52 of first and second portions 38, 48 define a passage through retaining member 32 when first and second portions 38, 48 are positioned relative to one another in the closed configuration. In addition, when first and second portions 38, 48 are positioned relative to one another in the closed configuration, openings 42, 54 define a single opening enclosed by first and second portions 38, 48 and openings 44, 56 define a single opening enclosed by first and second portions 38, 48. In the illustrated form, the single opening defined by openings 42, 54 includes a circular configuration and a first diameter, and the single opening defined by openings 44, 56 includes a circular configuration and a second diameter which is smaller than the first diameter. However, it should be appreciated that alternative shapes and sizes are possible for these openings. In addition, in one or more forms all or part of retaining member 32 may be formed of a translucent material to facilitate passage of light from a plug end which may be positioned therein. In one non-illustrated form, it is further contemplated that all or part of the hollow interiors 40, 52 of first and second portions 38, 48 may be provided with a conforming material. In this configuration, the conforming material would be compressed to define the passage (in whole or in part) in retaining member 32 when it is engaged with plug member 18 and cord 12. Further details regarding the engagement of retaining member 32 with plug member 18 and cord 12 will be provided below.

As indicated above, assembly 10 also includes a strain relief member 68, although forms in which strain relief member 68 is not included in assembly 10 are also possible. Generally speaking, strain relief member 68 is configured to engage with a portion of cord portion 16 and plug 14 of cord 12 in order to provide rigidity to cord 12 in this area and/or otherwise limit or control bending of plug 14 relative to cord portion 16. In this respect, strain relief member 68 may be formed of a rigid or semi-rigid material and/or include one or more reinforcing elements. However, forms where strain relief member 68 is formed of a pliable or semi-pliable material are also contemplated.

Figure 4:
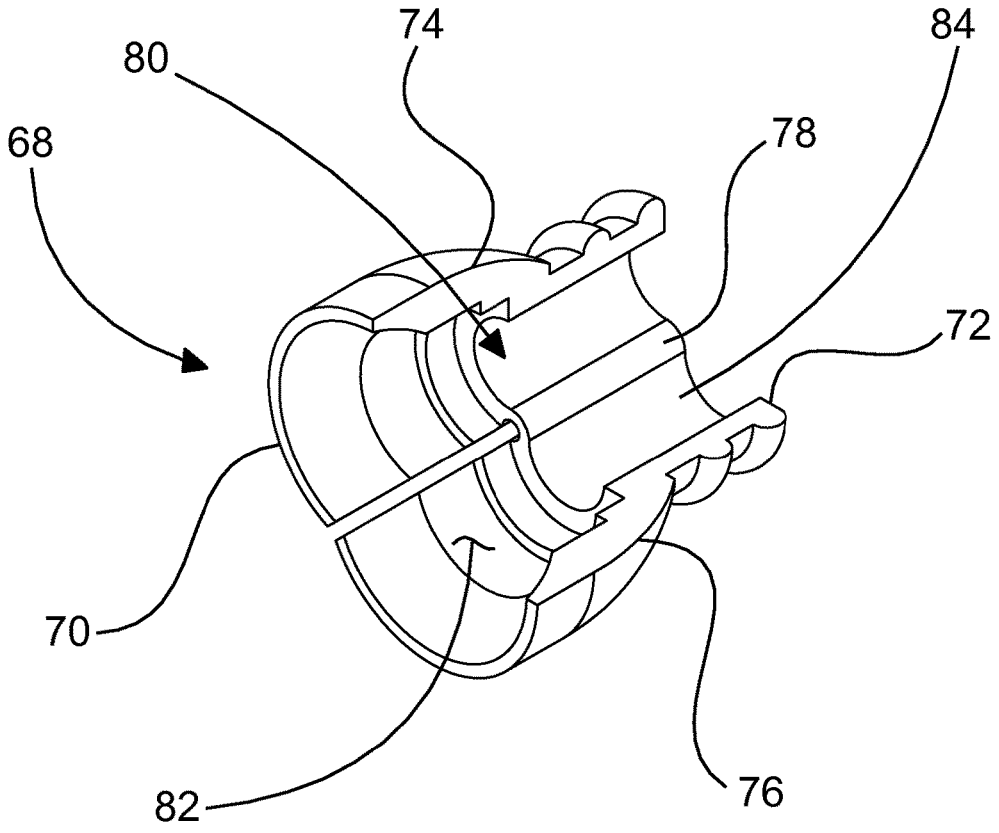
FIG. 4 is a perspective view of a strain relief member of the plug assembly of FIG. 1.
Figure 5:
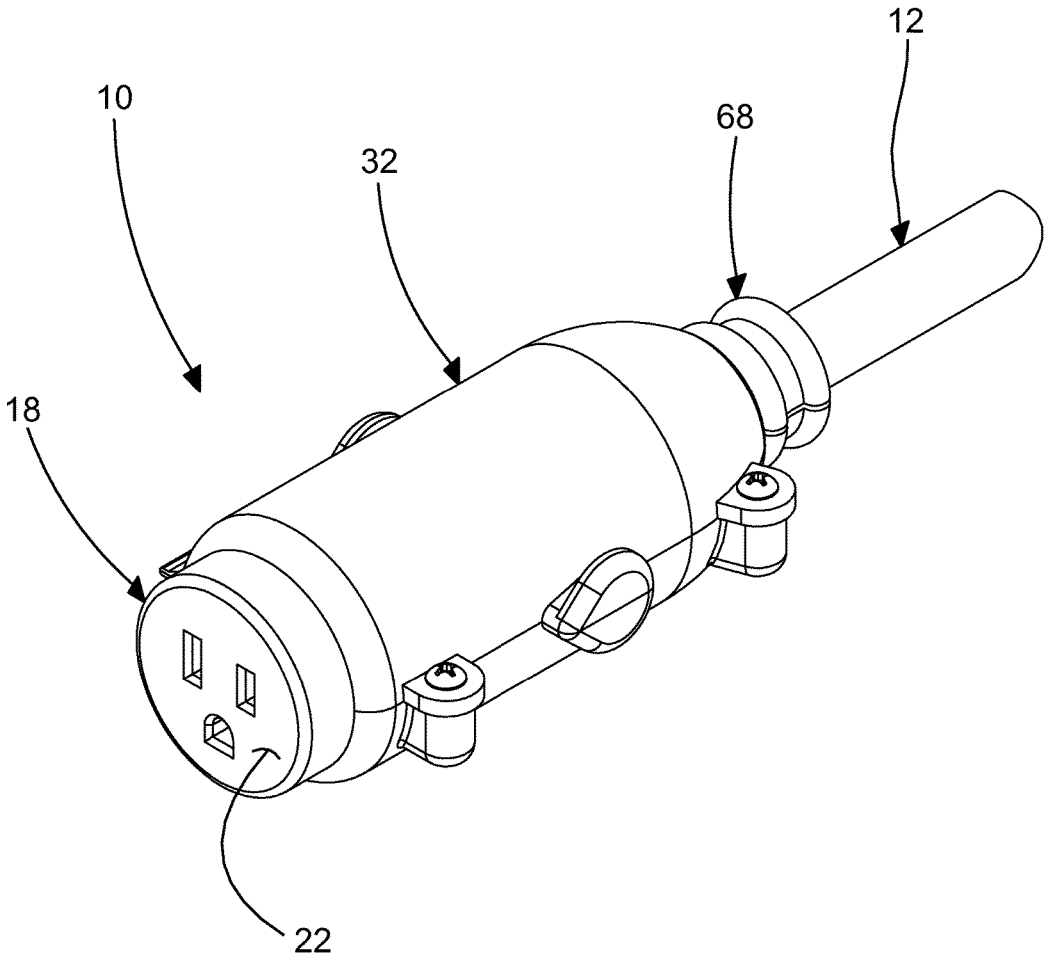
FIG. 5 is a perspective view of the plug assembly of FIG. 1 engaged with the female end of a cord.

Referring more particularly to FIG. 4, strain relief member 68 extends between a first end 70 and an opposite second end 72 and includes a body separated into a first portion 74 and a second portion 76 coupled with first portion 74 by an intermediate portion 78. In this configuration, intermediate portion 78 provides a living hinge between first and second portions 74, 76 such that these portions are movable relative to one another between an open configuration (FIG. 4) and a closed configuration (FIG. 1). However, it should be understood that alternative arrangements for permitting movement between first and second portions 74, 76 are possible. Strain relief member 68 may be positioned about cord 12 when it is in the open configuration and then first and second portions 74, 76 may be moved relative to one another to the closed configuration in order to engage cord 12 with strain relief member 68.

Strain relief member 68 also includes a passage 80 configured to receive one or more portions of cord 12 therein. More particularly, in the illustrated form passage 80 includes a first portion 82 configured to receive a stepped/tapered portion 15 of plug 14 and a second portion 84 configured to receive a portion of cord portion 16 of cord 12. Similarly, in this configuration, first portion 84 includes a stepped/tapered configuration which corresponds to portion 15 of plug 14 and second portion 84 includes a generally cylindrical configuration which corresponds to the external profile of cord portion 16 of cord 12. As will be described in greater detail below, strain relief member 68 is generally held in engagement with cord 12 by retaining member 32. However, in addition to or in lieu of this interaction with retaining member 32, it is contemplated that strain relief member 68 could include one or more features configured to retain it in its closed configuration. For example, one of first and second members 74, 76 may include a latching mechanism, projection, tab, etc. which engages with suitable structure on the other of first and second members 74, 76 in order to maintain the closed configuration of strain relief member 68. Additionally or alternatively, one or more adhesives may be utilized to maintain strain relief member 68 in its closed configuration and in engagement with cord 12.

In order to couple plug assembly 10 with cord 12, plug member 18 is engaged with plug 14 and strain relief member 68 is engaged with cord 12 as described above. Once these components are positioned accordingly, retaining member 32 may be engaged with plug member 18 and cord 12. As indicated above, retaining member 32 may be positioned relative to plug member 18 and cord 12 when it is in the open configuration, and then first and second portions 38, 48 of retaining member 32 may be moved relative to one another to the closed configuration in order to bring retaining member 32 into engagement with plug member 18 and cord 12. Fasteners 64, 66 may then be engaged with receptacles 43*a*, 43*b* in order to retain retaining member 32 in the closed configuration and in engagement with plug member 18 and cord 12.

In the illustrated form, second end 36 of retaining member 32 is positioned over and engages with strain relief member 68 at a location at or near where plug portion 16 extends from plug 14, although it should be appreciated that alternative configurations are possible. In this arrangement, since the dimensions of the opening formed by openings 44, 56 of retaining member 32 are smaller than the dimensions of plug 14, axial displacement of retaining member 32 from cord 12 is prevented. As indicated above, forms in which strain relief member 68 is not utilized are also possible. In these forms, retaining member 32 may engage directly with cord 12 in a manner similar to that described in connection with its engagement with strain relief member 68.

In addition, while not previously discussed it should be appreciated that projections 45, 53 of retaining member 32 are received in receptacle 30 of plug member 18 and that projections 47, 51 of retaining member 32 are received in receptacle 28 of plug member 18 when retaining member 32 is engaged therewith. In this configuration, the interaction between projections 45, 47 and 51, 53 of retaining member 32 and receptacles 28, 30 of plug member 18 prevents axial displacement and disengagement of plug member 14 from cord 12.

It should also be understood that plug member 18 is still accessible for engagement by another plug member or a power source when it is engaged with retaining member 32. More specifically, as illustrated in in FIG. 1 for example, male end 20 extends outwardly from retaining member 32 such that it may be engaged with the female end of another plug or with a power source such as an outlet. Similarly, in this arrangement end 34 of retaining member 32 is positioned between male and female ends 20, 22 of plug member 18 when retaining member 32 is engaged with plug member 18 and cord 12. While not shown, the other plug which further engages with illustrated plug member 18 may be a plug member of another plug assembly 10 engaged with another cord. In this arrangement, a band, wire, tie or other component may be engaged with one or more of first projections 46 and the second projections of first portion 38 and first projections 58 and second projections 59 of second portion 48 of adjacent retaining members 32 in order to prevent the adjacent plug members 18 from disengaging with one another.

Once plug assembly 10 is engaged with cord 12, it may be used according to normal practice. In the event plug member 18 becomes damaged during such use, e.g., if a prong breaks off, then retaining member 32 may be removed from cord 12, a new, non-damaged plug member 18 may be engaged with cord 12, and retaining member 32 may be re-engaged with cord 12 and the new plug member 18. In this respect, a new undamaged plug end may be added to cord 12 without removing or disturbing the original, factory-installed plug.

Figure 6:
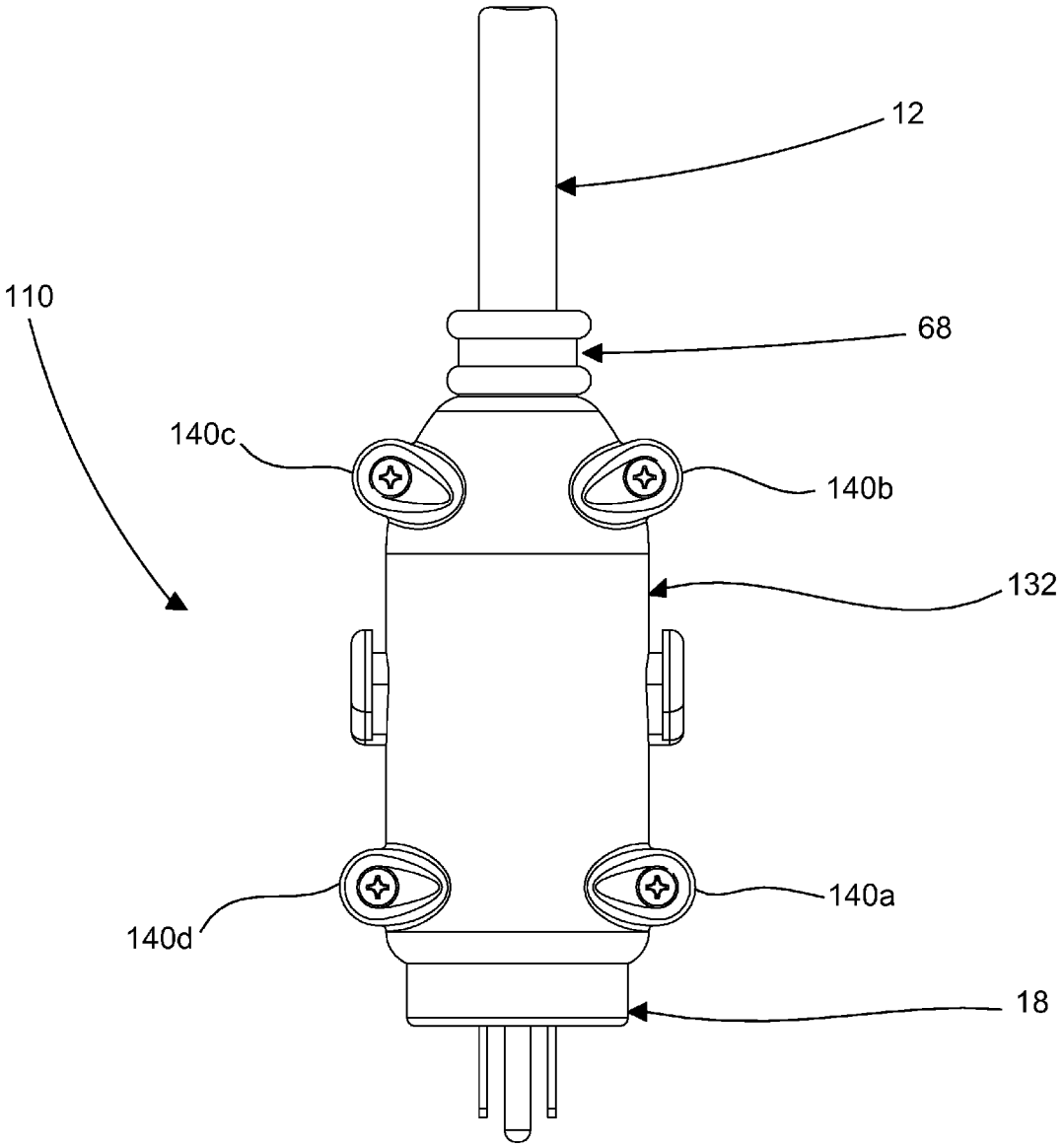
FIG. 6 is a top plan view of an alternative embodiment plug assembly.
Figure 7:
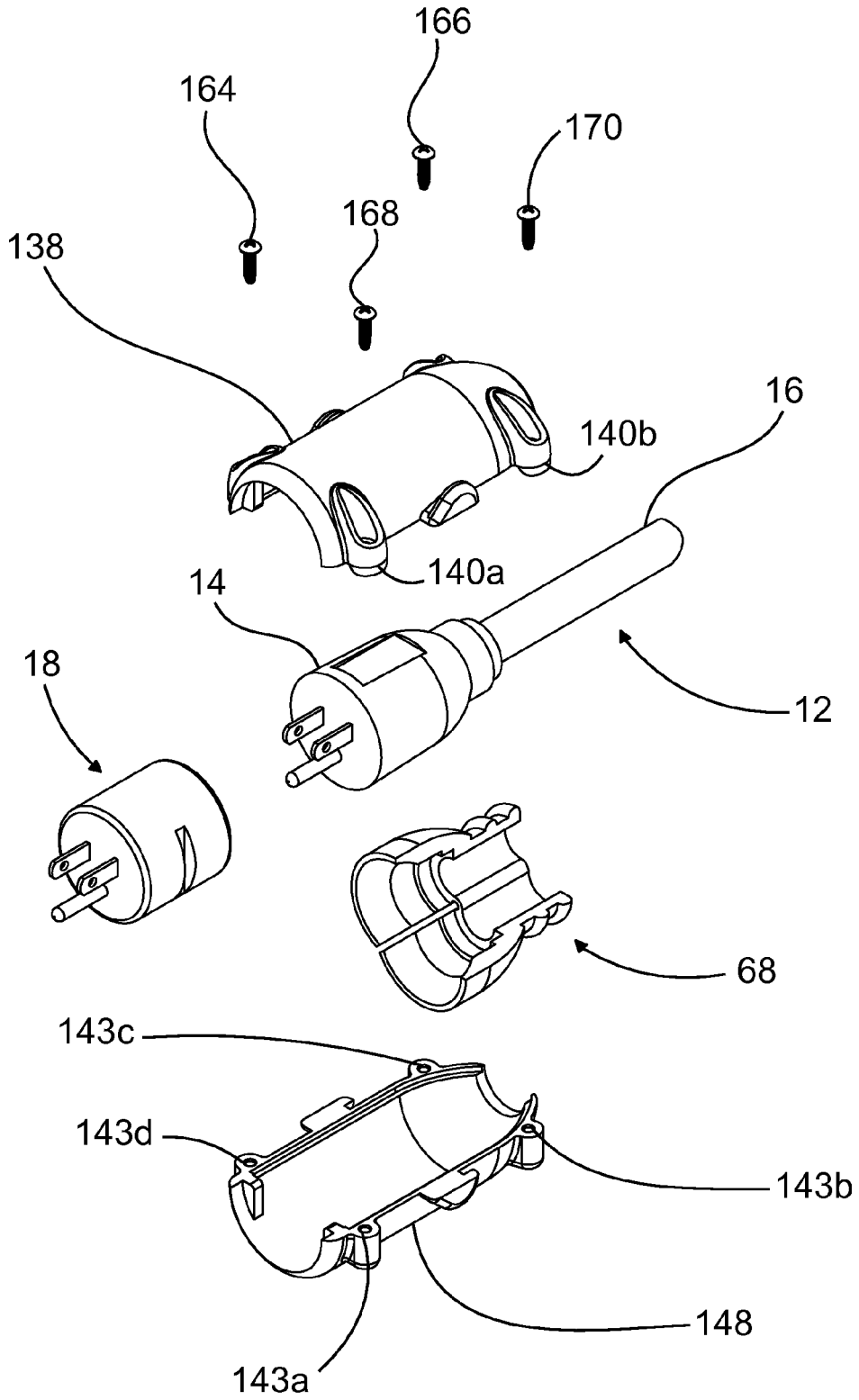
FIG. 7 is an exploded view of the plug assembly of FIG. 6.
Figure 8:
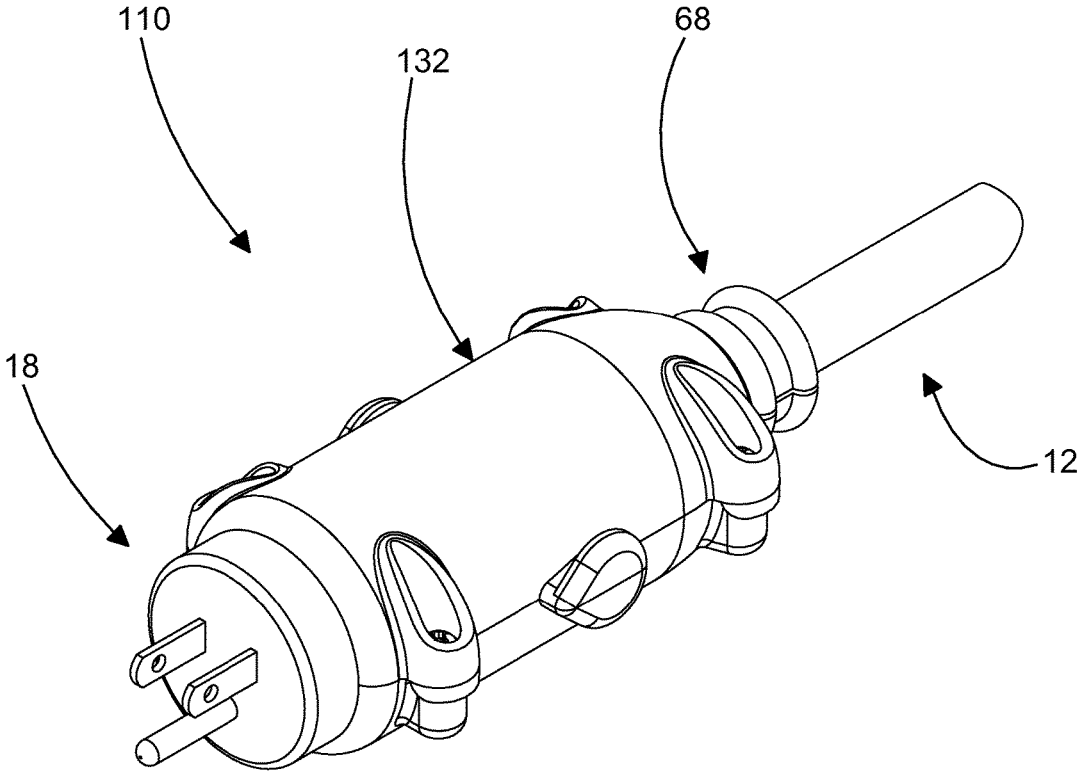
FIG. 8 is a perspective view of the plug assembly of FIG. 6.

An alternative embodiment plug assembly 110 is illustrated in FIGS. 6-8, where like numerals refer to like features previously described. Plug assembly 110 is substantially similar to plug assembly 10 with the exception of alternatively designed retaining member 132. Beyond those distinctions described herein below, retaining member 132 is configured the same as retaining member 32 and engages with plug member 18 and cord 12 in the same manner as that described above with respect to retaining member 32. Retaining member 132 is separated into a first portion 138 and a second portion 148 which may be positioned in engagement with one another in order to engage retaining member 132 with plug member 18 and cord 12 as described above. First portion 138 includes a plurality of receptacles 140*a*-140*d* configured to receive a respective one of fasteners 164-170 which are configured to engage with apertures 143*a*-143*d* of second portion 148 in order to maintain engagement of first and second portions 138, 148 to one another and of retaining member 132 with plug member 18 and cord 12.

In the illustrated form, fastening members 164-170 are threaded screws although other forms for fastening members 164-170 are contemplated. Retaining member 132 may also include one or more features in addition to or in lieu of fasteners 164-170 for maintaining engagement of first and second portions 138, 148 to one another and of retaining member 132 with plug member 18 and cord 12. For example, in one non-illustrated form, one of first and second portions 138, 148 may include a latching mechanism, projection, tab, etc. which engages with suitable structure on the other of first and second portions 138, 148 in order to maintain engagement of first and second portions 138, 148 with one another.

Figure 9:
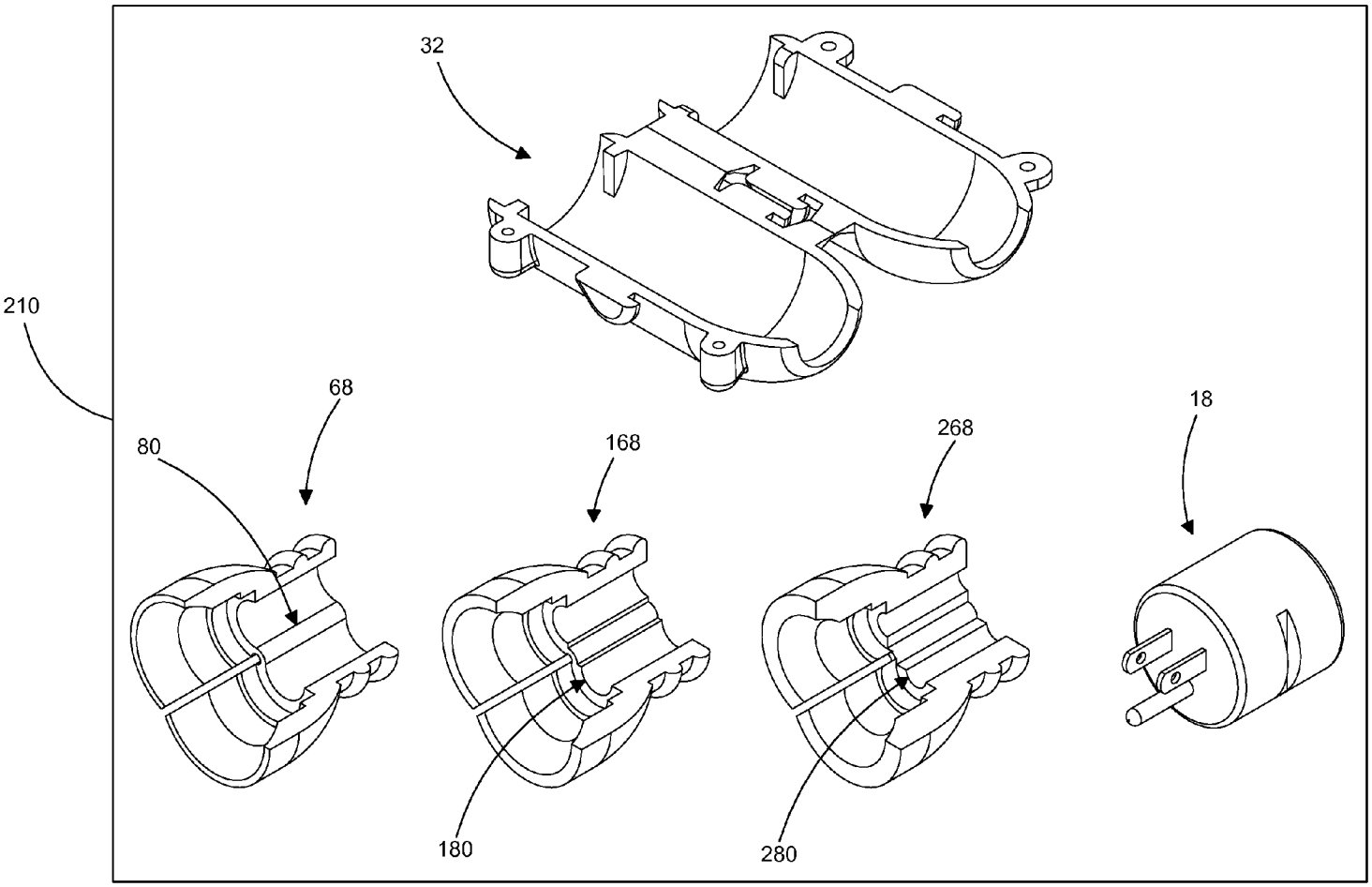
FIG. 9 is a perspective view of a kit including a plug assembly with a plurality of different strain relief members.

Turning now to FIG. 9, where like numerals refer to like features previously described, further details of a kit 210 will be provided. Kit 210 includes retaining member 32, plug member 18 and a plurality of strain relief members 68, 168, 268. Kit 210 also includes packaging or other materials suitable for holding these components. Strain relief members 168, 268 are substantially similar to strain relief member 68 described above except that passage 180 of strain relief member 168 is smaller than passage 80 of strain relief member 68 and passage 280 of strain relief member 268 is smaller than passages 80, 180 of strain relief members 68, 168, respectively. The exterior profile, including for example size and shape, of strain relief members 168, 268 is the same or substantially similar to that of strain relief member 68 such that retaining member 32 may also readily engage with strain relief members 168, 268.

The different sizes of passages 80, 180, 280 facilitate use of retaining member 32 and plug member 18 with a variety of different sized cords 12. For example, if a cord includes a smaller plug end 14 and smaller cord portion 16 than what is illustrated with respect to cord 12, then one of strain relief members 168, 268 may be selected for use and retaining member 32 can still be used. While differences in the size of passages 80, 180, 280 have been described, it should be appreciated that kit 210 could include a plurality of strain relief members that include differences in passages 80, 180, 280 in addition to or in lieu of size. For example, each of passages 80, 180, 280 could be shaped differently to facilitate their use with differently shaped cords such as flat, braided or cylindrical cords, just to provide a few non-limiting examples. In addition, in the illustrated form, the portions of passages 180 and 280 configured to receive plug end 14 and cord portion 16 are smaller than those of strain relief member 68 such that each is configured to engage with a cord that includes a smaller plug end portion 14 and a smaller cord portion 16. However, forms in which the portions of passages 180 and 280 configured to receive plug end 14 and cord portion 16 are different are also possible. For example, in one form, one or both of passages 180 and 280 may be configured to receive a plug end 14 that is the same as that illustrated with respect to cord 12 and to receive a cord portion 16 which is smaller than that illustrated with respect to cord 12, or vice versa.

While the plug assemblies disclosed herein are described in connection with electrical powers cords, it should be appreciated that they could be modified for use in connection with different types of cords that include plugs, including but not limited to Ethernet cords, USB cords, video cords, fiber optic cords and/or audio cords, just to provide a few non-limiting examples.

In one embodiment, an assembly includes a first plug member extending between a first end and an opposite second end. The first end is structured to engage with a second plug member and the second end is structured to engage with a third plug member. The assembly also includes a retaining member extending between a first end and an opposite second end, and it is engageable with the first plug member when the first and second plug members are engaged with one another in order to retain engagement of the first and second plug members with one another. The first end of the retaining member is positioned between the first and second ends of the first plug member when the retaining member is engaged with the first plug member.

In one form of this embodiment, the retaining member includes a first portion and a second portion hingedly coupled to one another. The first and second portions are positionable between a closed configuration for engaging with the first plug member and an open configuration for releasing the first plug member.

In one aspect of this form, the first and second portions are further configured to engage with one another to retain the retaining member in the closed configuration.

In another aspect of this form, the assembly further includes a plurality of fasteners configured to engage with the first and second portions of the retaining member to retain the retaining member in the closed configuration.

In another form of this embodiment, the first plug member includes at least one receptacle positioned between the first and second ends thereof and the retaining member includes at least one projection structured to engage with the at least one receptacle of the first plug member.

In one aspect of this form, the at least one receptacle extends transversely to an axis extending between the first and second ends of the first plug member.

In still another form of this embodiment, the retaining member includes a first portion and a second portion engageable with the first portion.

In one aspect of this form, the assembly further includes a plurality of fasteners configured to retain the first and second portions of the retaining member in engagement with one another.

In still another form of this embodiment, the retaining member is formed of a translucent material.

In yet another form of this embodiment, the second end of the retaining member is configured to engage with at least one of the second plug member and a cord extending from the second plug member at a location at or near where the cord extends from the second plug member when the first plug member and the second plug member are engaged with one another.

In another form of this embodiment, the assembly further includes a strain relief member engageable with a cord extending from the second plug member.

In one aspect of this form, the second end of the retaining member is configured to engage with at least a portion of the strain relief member when the strain relief member is engaged with the cord and the retaining member is engaged with the first plug member.

In another embodiment, an assembly includes a first plug member including a female end portion opposite a male end portion, and a retaining element configured to engage with the first plug member and at least a portion of a cord including a second plug member configured to engage with the first plug member. One of the female end portion and the male end portion of the first plug member is accessible for engagement with a third plug member when the retaining element is engaged with the first plug member.

In one form of this embodiment, the retaining element defines a passage extending between a first opening and an opposite second opening.

In one aspect of this form, the first and second openings are different sizes.

In another aspect of this form, the first opening is sized and shaped to receive a portion of the first plug member when the retaining element is engaged with the first plug member.

In still another aspect of this form, the second opening is sized and shaped to receive at least a portion of the cord.

In yet another aspect of this form, one of the female end portion and the male end portion of the first plug member extends outwardly from the first opening of the retaining element when the retaining element is engaged with the first plug member.

In another aspect of this form, the cord includes a cord portion extending from the second plug member and a portion of the retaining member extends around the cord portion and the second plug member is positioned in the passage of the retaining member when the retaining member is engaged with the first plug member and the cord.

In another form of this embodiment, the retaining member includes a first portion and a second portion hingedly coupled to one another, and the first and second portions are positionable between a closed configuration for engaging with the first plug member and at least one portion of the cord and an open configuration for releasing the first plug member and the at least one portion of the cord.

In one aspect of this form, the first and second portions of the retaining member are further configured to engage with one another to retain the retaining member in the closed configuration.

In still a further aspect of this form, the assembly further includes a plurality of fasteners configured to engage with the first and second portions of the retaining member to retain the retaining member in the closed configuration.

In yet another form of this embodiment, the first plug member includes at least one groove positioned between the male and female end portions, and the retaining member includes at least one projection structured to engage with the at least one groove of the first plug member.

In one aspect of this form, the at least one projection extends transversely to an axis extending between opposite ends of the retaining member.

In another form of this embodiment, the retaining member includes a first portion and a second portion engageable with the first portion.

In one aspect of this form, the assembly further includes a plurality of fasteners configured to retain the first and second portions of the retaining member in engagement with one another.

In still another form of this embodiment, the assembly further includes a strain relief member engageable with the cord.

In one aspect of this form, a portion of the retaining member is configured to engage with at least a portion of the strain relief member when the strain relief member is engaged with the cord.

In a further embodiment, a kit includes a first plug member including a female end portion opposite a male end portion; a retaining element structured to retain the first plug member in engagement with a second plug member of a cord; and a plurality of strain relief members each including an exterior profile and an engaging portion configured to engage with at least one portion of the cord. The exterior profile is the same for each of the plurality of strain relief members and the configuration of the engaging portion is different for each of the plurality of strain relief members.

In one form of this embodiment, the retaining element is configured to engage about the exterior profile of each of the plurality of strain relief members when a respective strain relief member is engaged with a cord.

In another form of this embodiment, at least one of size and shape of the configuration of the engaging portion is different for each of the plurality of strain relief members.

In another embodiment, a method includes engaging a first plug member including a male end portion and a female end portion with a second plug member; engaging a strain relief member around a cord extending from the second plug member; and positioning a retaining member around a portion of the first plug member and a portion of the strain relief member with one of the male end portion and the female end portion of the first plug member extending outwardly from the retaining member.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An assembly, comprising:

a first plug member including a female end portion opposite a male end portion;

a retaining element configured to engage with the first plug member and at least a portion of a cord including a second plug member configured to engage with the first plug member; and a strain relief member configured to engage with the cord, the strain relief member including a first portion configured to receive at least a portion of the second plug member and a second portion configured to receive at least a portion of the cord extending from the second plug member;

wherein one of the female end portion and the male end portion of the first plug member is accessible for engagement with a third plug member, and the strain relief member engages with the second plug member and at least a portion of the cord and is positioned between the second plug member and the retaining element and the retaining element is positioned around and engages over the strain relief member with a portion of the second portion of the strain relief member extending from the retaining element when the retaining element is engaged with the first plug member and the strain relief member is engaged with the cord.

2. The assembly of claim 1, wherein the retaining element defines a passage extending between a first opening and an opposite second opening.

3. The assembly of claim 2, wherein the first and second openings are different sizes.

4. The assembly of claim 2, wherein the first opening is sized and shaped to receive a portion of the first plug member when the retaining element is engaged with the first plug member.

5. The assembly of claim 2, wherein the second opening is sized and shaped to receive at least a portion of the cord.

6. The assembly of claim 2, wherein one of the female end portion and the male end portion of the first plug member extends outwardly from the first opening of the retaining element when the retaining element is engaged with the first plug member.

7. The assembly of claim 2, wherein a portion of the retaining member extends around the cord extending from the second plug member and the second plug member is positioned in the passage of the retaining member when the retaining member is engaged with the first plug member and the cord.

8. The assembly of claim 1, wherein the retaining member includes a first portion and a second portion hingedly coupled to one another, the first and second portions being positionable between a closed configuration for engaging with the first plug member and at least one portion of the cord and an open configuration for releasing the first plug member and the at least one portion of the cord.

9. The assembly of claim 8, wherein the first and second portions of the retaining member are further configured to engage with one another to retain the retaining member in the closed configuration.

10. The assembly of claim 8, further comprising a plurality of fasteners configured to engage with the first and second portions of the retaining member to retain the retaining member in the closed configuration.

11. The assembly of claim 1, wherein the first plug member includes at least one groove positioned between the male and female end portions, and the retaining member includes at least one projection structured to engage with the at least one groove of the first plug member.

12. The assembly of claim 11, wherein the at least one projection extends transversely to an axis extending between opposite ends of the retaining member.

13. The assembly of claim 1, wherein the retaining member includes a first portion and a second portion engageable with the first portion.

14. The assembly of claim 13, further comprising a plurality of fasteners configured to retain the first and second portions of the retaining member in engagement with one another.

15. A kit, comprising:

a first plug member including a female end portion opposite a male end portion;

a retaining element structured to retain the first plug member in engagement with a second plug member of a cord; and a plurality of strain relief members configured to engage with the cord, each of the strain relief members including an exterior profile and an engaging portion including a first portion configured to receive at least a portion of the second plug member and a second portion configured to receive at least a portion of the cord extending from the second plug member, wherein the exterior profile is the same for each of the plurality of strain relief members and the configuration of the engaging portion is different for each of the plurality of strain relief members;

wherein the retaining element is structured to be positioned around and engage with the first plug member and the second plug member with one of the plurality of strain relief members engaging with a portion of the cord and the second plug member and being positioned between the second plug member and the retaining element with at least a portion of the strain relief member extending from the retaining element around the portion of the cord extending from the second plug member.

16. The kit of claim 15, wherein the retaining element is configured to engage about the exterior profile of each of the plurality of strain relief members when a respective strain relief member is engaged with a cord.

17. The kit of claim 15, wherein at least one of size and shape of the configuration of the engaging portion is different for each of the plurality of strain relief members.

18. A method, comprising:

engaging a first plug member including a male end portion and a female end portion with a second plug member;

engaging a strain relief member with at least a portion of the second plug member and at least a portion of a cord extending from the second plug member; and positioning a retaining member around the second plug member and a portion of the first plug member with the strain relief member positioned between the second plug member and the retaining element, a portion of the strain relief member extending from the retaining element and one of the male end portion and the female end portion of the first plug member extending outwardly from the retaining member.

* * * * *